US010743651B2

(12) United States Patent
Taniguchi et al.

(10) Patent No.: US 10,743,651 B2
(45) Date of Patent: Aug. 18, 2020

(54) METHOD OF MANUFACTURING A BRUSH, AND BRUSH

(71) Applicant: SANWA TOOTH BRUSH INDUSTRIAL LIMITED PARTNERSHIP, Yao, Osaka (JP)

(72) Inventors: Keiji Taniguchi, Yao (JP); Katsutoshi Taniguchi, Yao (JP)

(73) Assignee: SANWA TOOTH BRUSH INDUSTRIAL LIMITED PARTNERSHIP, Osaka (JP)

( * ) Notice: Subject to any disclaimer, the term of this patent is extended or adjusted under 35 U.S.C. 154(b) by 169 days.

(21) Appl. No.: 15/575,215

(22) PCT Filed: Apr. 14, 2016

(86) PCT No.: PCT/JP2016/062034

§ 371 (c)(1),
(2) Date: Nov. 17, 2017

(87) PCT Pub. No.: WO2016/189996

PCT Pub. Date: Dec. 1, 2016

(65) Prior Publication Data

US 2018/0146774 A1 May 31, 2018

(30) Foreign Application Priority Data

May 26, 2015 (JP) ..... 2015-106536

(51) Int. Cl.
*A46D 3/04* (2006.01)
*A46B 3/02* (2006.01)
(Continued)

(52) U.S. Cl.
CPC ..... *A46D 3/04* (2013.01); *A46B 3/02* (2013.01); *A46B 3/06* (2013.01); *A46B 9/04* (2013.01);
(Continued)

(58) Field of Classification Search
USPC ..... 300/2, 4, 8, 21; 15/167.1, 207.2
See application file for complete search history.

(56) References Cited

U.S. PATENT DOCUMENTS 3,597,787 A * 8/1971 Rosendall ..... A46B 5/00 15/179
5,458,400 A * 10/1995 Meyer ..... A46D 3/005 264/243
(Continued)

FOREIGN PATENT DOCUMENTS

JP S 55-116520 U1 8/1980
JP S 59-029935 U1 2/1984
(Continued)

OTHER PUBLICATIONS

International Search Report dated May 31, 2016, issued to the corresponding International Application No. PCT/JP2016/062034.
(Continued)

*Primary Examiner* — Joseph J Hail
*Assistant Examiner* — Shantese L Mcdonald
(74) *Attorney, Agent, or Firm* — Stein IP, LLC

(57) ABSTRACT

This method of manufacturing a brush 1 comprises: a first step of forming a support body 10 in which through holes 14 are formed; and a second step of inserting a brush bristle 20 in a bent state into each through hole 14 from one side of the through hole 14 to cause a looped bristle to project from the through hole 14 on the other side.

17 Claims, 8 Drawing Sheets

(51) Int. Cl.

| | |
|---|---|
| ***A46B 9/04*** | (2006.01) |
| ***A46D 1/00*** | (2006.01) |
| ***A46B 15/00*** | (2006.01) |
| ***A46B 3/06*** | (2006.01) |

(52) U.S. Cl.
CPC ..... *A46B 15/0081* (2013.01); *A46D 1/0253* (2013.01)

(56) References Cited

U.S. PATENT DOCUMENTS

| | | | | |
|---|---|---|---|---|
| 5,474,366 | A * | 12/1995 | Strutt | A46D 3/005 300/21 |
| 7,281,768 | B2 * | 10/2007 | Sato | A46B 3/02 300/2 |
| 2002/0011251 | A1 * | 1/2002 | Gueret | A45D 40/267 132/218 |
| 2011/0304194 | A1 * | 12/2011 | Uchida | A46B 9/04 300/21 |

FOREIGN PATENT DOCUMENTS

| | | | |
|---|---|---|---|
| JP | H 5-29425 | U | 4/1993 |
| JP | 3016619 | U | 7/1995 |
| JP | H 10-57144 | A | 3/1998 |
| JP | 11-113934 | A | 4/1999 |
| JP | 2000-050958 | A | 2/2000 |
| JP | 2000-50958 | A | 2/2000 |
| JP | 2001-87039 | A | 4/2001 |
| JP | 2004-558 | A | 1/2004 |
| JP | 2005-342534 | A | 12/2005 |
| JP | 2008-000265 | A1 | 1/2008 |
| JP | 2012-115445 | A | 6/2012 |
| WO | WO 98/00048 | A1 | 1/1998 |

OTHER PUBLICATIONS

Extended European Search Report dated Dec. 19, 2018, issued by the European Patent Office in corresponding application EP 16799704.8.

* cited by examiner

METHOD OF MANUFACTURING A BRUSH, AND BRUSH

CROSS-REFERENCE TO RELATED APPLICATIONS

This application is a national stage of International Application No. PCT/JP2016/062034, filed Apr. 14, 2016, which claims the benefit of priority to Japanese Application No. 2015-106536, filed May 26, 2015, in the Japanese Patent Office, the disclosures of which are incorporated herein in their entireties by reference.

TECHNICAL FIELD

The present invention relates to a method of manufacturing a brush, and to a brush.

BACKGROUND ART

There are conventionally known toothbrushes and tongue coat removal utensils in which looped bristles (bristles in loops) are implanted in a base (see, for example, Patent Documents 1 and 2 identified below). It is believed that, by adopting a structure in which looped bristles are implanted in a base, it is possible to provide toothbrushes that allow efficient brushing of the teeth without hurting or damaging the gum (see Patent Document 1). It is also believed that, by adopting a structure in which looped bristles are implanted in a base, it is possible to provide tongue coat removal utensils that can be used hygienically, are less prone to induce vomiting reflex, and allow efficient removal of tooth coat without damaging the tongue (see Patent Document 2).

LIST OF CITATIONS

Patent Literature

Patent Document 1: Japanese Patent Application published as No. 2004-558

Patent Document 2: Japanese Patent Application published as No. H11-113934

SUMMARY OF THE INVENTION

Technical Problem

In conventional toothbrushes and tongue coat removal utensils provided with looped bristles, the looped bristles are fastened by being, at their base end (root), set in depressions formed in the base or by being fused to the base at the surface to which they are fitted. These structures are considered to suffer from poor handling of the looped bristles and possible difficulty implanting the looped bristles in the base. In particular, brushes with a low looped bristle height (height from the surface of the base to the crest of the looped bristles) are considered to be difficult to manufacture.

On the other hand, in a method of manufacturing toothbrushes and tongue coat removal utensils provided with looped bristles, it is possible to introduce in-molding whereby a base is formed using a mold in which bristles in loops fused at ends are arranged. It is, however, feared that such a manufacturing method may require a large investment in equipment.

Against the background discussed above, an object of the present invention is to provide a method of easily manufacturing a brush provided with looped bristles. Another object of the present invention is to provide a method of manufacturing a brush provided with looped bristles while suppressing equipment cost. Yet another object of the present invention is to provide a technology suitable for oral cavity cleaning utensils.

Means for Solving the Problem

To achieve the above objects, according to one aspect of the present invention, a method of manufacturing a brush includes: a first step of forming a base with a through-hole; and a second step of inserting a curved brush bristle into the through-hole from one end of the through-hole and making a looped bristle protrude from another end of the through-hole (a first configuration).

With this configuration, for example, by inserting, with an implanting needle, the brush bristle folded in two into the through-hole, it is possible to obtain a structure where the looped bristle protrudes from the surface of the base. This makes it easy to manufacture a brush provided with a looped bristle. Moreover, with this configuration, it is possible to manufacture a brush provided with a looped bristle by use of existing equipment that produces a tooth brush by driving in, along with a staple, a tuft of bristles in an implanting hole (groove). That is, this configuration makes it possible to manufacture a brush provided with a looped bristle with a small investment in equipment.

Preferably, the brush manufacturing method of the first configuration described above further includes a third step of fastening the brush bristle including the looped bristle to the base (a second configuration). This configuration helps make it less likely that the looped bristle provided on the base comes off the base easily.

In the brush manufacturing method of the second configuration described above, the brush bristle may be fastened to the base by fusion (a third configuration). Fusion can be achieved, for example, by thermal fusion, high-frequency fusion, ultrasonic fusion, or laser fusion. This configuration makes it possible to manufacture a brush provided with a looped bristle while suppressing the cost of equipment.

In the brush manufacturing method of the third configuration described above, the brush bristle may be fastened to the base at the one end of the through-hole (a fourth configuration). This configuration provides, for example, a tongue brush. Or, in the brush manufacturing method of the third configuration described above, the brush bristle may be fastened to the base at the another end of the through-hole (a fifth configuration). This configuration provides, for example, a toothbrush.

The brush manufacturing method of any of the second to fifth configurations described above may further include: a step of covering the part where the brush bristle is fastened to the base with a cover (a sixth configuration). With this configuration, it is easy to provide, for example, a brush that excels in safety. Moreover, with this configuration, it is easy to provide a brush with a good appearance.

In the brush manufacturing method of any of the first to sixth configurations described above, the base may have a projection that projects from the inner wall face forming the through-hole (a seventh configuration). With this configuration, when the implanting needle inserted along with the brush bristle in the through-hole is pulled out of it, the projection makes contact with the brush bristle, and this helps prevent the brush bristle from moving together with the implanting needle.

In the brush manufacturing method of any of the first to seventh configurations described above, the through-hole may be non-circular as seen in a plan view (an eighth configuration). This configuration helps prevent rotation of a tuft of brush bristles inserted in the through-hole.

To achieve the above objects of the present invention, according to another aspect of the present invention, a brush includes: a base; and a brush bristle protruding in a loop from a first face of the base and fastened to the base at a second face of the base, the second base being reverse to the first face (a ninth configuration).

Provided with a brush bristle in a loop, the brush of this configuration can suitably be used as a tongue brush that excels in safety. Moreover, the brush of this configuration can be manufactured easily by inserting a curved brush bristle into a through-hole provided in the base, and thus can be manufactured at low cost and with a low work load.

The brush of the ninth configuration described above may further include a cover fitted on the second face of the base to cover the part where the brush bristle is fastened (a tenth configuration). With this configuration, it is easy to provide, for example, a brush that excels in safety. Moreover, with this configuration, it is easy to provide a brush with a good appearance.

To achieve the above objects of the present invention, according to yet another aspect of the present invention, a brush includes: a base; and a brush bristle protruding generally straight from a first face of the base and protruding in a loop from a second face of the base, the second base being reverse to the first face (an eleventh configuration).

The brush of this configuration is convenient because it can be used typically to brush the teeth at one face of the brush and to brush the tongue at the other face of the brush. Moreover, the brush of this configuration can be manufactured easily by inserting a curved brush bristle into a through-hole provided in the base, and thus it is possible to manufacture a multi-function brush at low cost and with a low work load.

In the brush of any of the ninth to eleventh configurations described above, the base may have a hole in which the brush bristle is inserted, and the base may have a projection that projects from the inner wall face forming the hole (a twelfth configuration). With this configuration, in the manufacture of the brush, when the implanting needle inserted along with the brush bristle in the hole is pulled out of it, the projection makes contact with the brush bristle, and this helps prevent the brush bristle from moving together with the implanting needle. That is, with this configuration, it is possible to manufacture a brush with stable quality.

In the brush of any of the ninth to twelfth configurations described above, the base may have a hole in which the brush bristle is inserted, and the hole may be non-circular as seen in a plan view (a thirteenth configuration). With this configuration, in the manufacture of the brush, it is possible to prevent rotation of a tuft of brush bristles inserted in the hole. That is, with this configuration, it is possible to manufacture a brush with stable quality.

Advantageous Effects of the Invention

According to the present invention, it is possible to provide a method of easily manufacturing a brush provided with looped bristles. According to the present invention, it is possible to provide a method of manufacturing a brush provided with looped bristles while suppressing equipment cost. According to the present invention, it is possible to provide a technology suitable for oral cavity cleaning utensils.

DESCRIPTION OF EMBODIMENTS

Hereinafter, brushes, and methods for manufacturing brushes, according to the present invention will be described in detail with reference to the accompanying drawings.

First Embodiment

Figure 1:
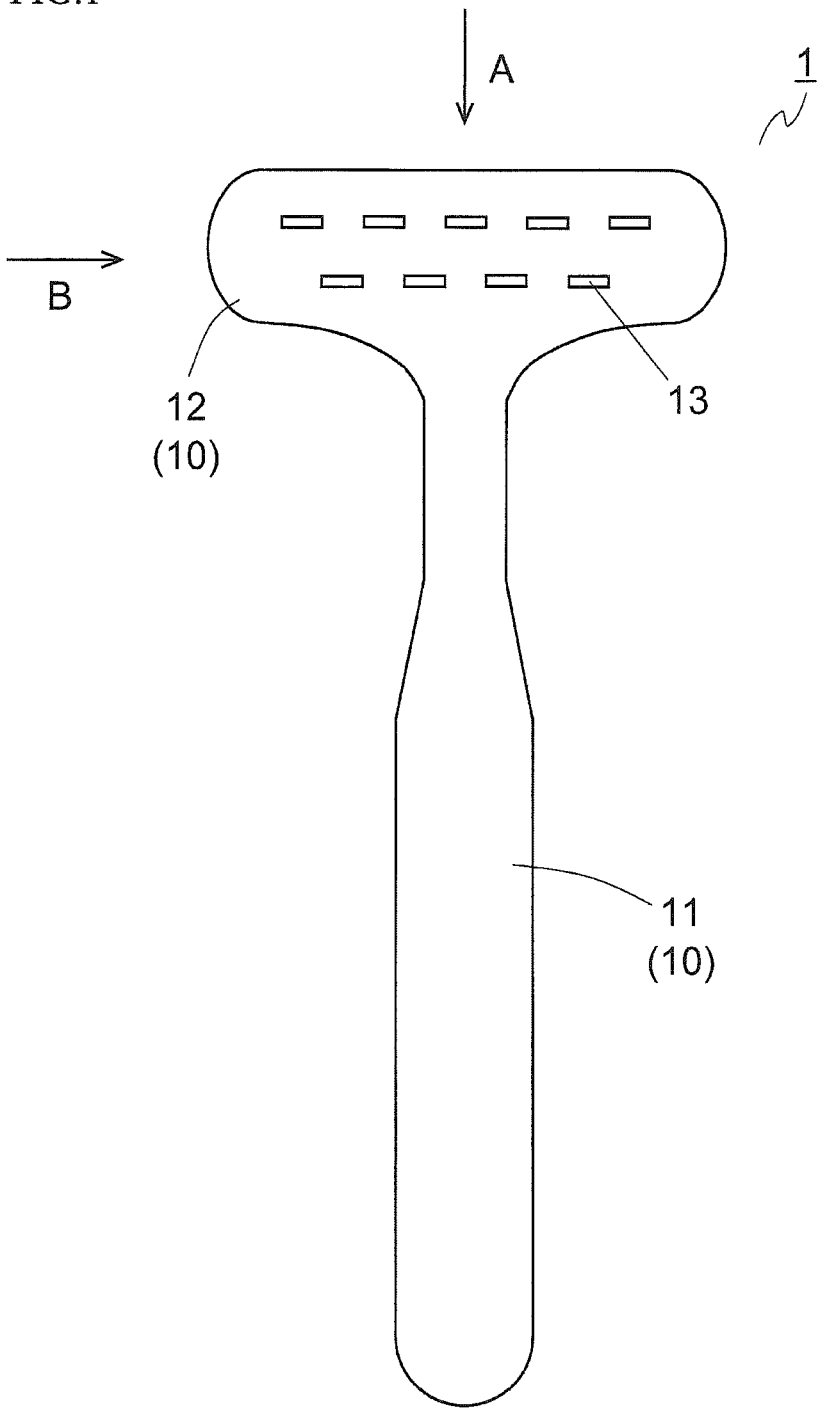
FIG. 1 is a schematic plan view showing the structure of a brush according to a first embodiment of the present invention.

FIG. 1 is a schematic plan view showing the structure of a brush 1 according to a first embodiment of the present invention. The brush 1 of the first embodiment is a brush for brushing the tongue. As shown in FIG. 1, the tongue brush 1 comprises a base 10, and the base 10 has a handle portion 11 which is elongate and is gripped in a hand of a user and a head portion 12 which is laterally wide and is provided at one end of the handle portion 11 in its longitudinal direction (the up-down direction in FIG. 1). The base 10, which is formed in a T-shape as seen in a plan view, can be formed of, but not limited to, synthetic resin such as polypropylene, acrylonitrile-styrene resin (AS resin), or saturated polyester; wood; or the like. The shape of the base 10 shown in FIG. 1 is merely an example; the shape of the base 10 may be modified as necessary. Although, in this embodiment, the handle portion 11 and the head portion 12 are together formed as a single member, they may instead be formed as separate members.

As shown in FIG. 1, in the head portion 12, there are disposed a plurality of cleaning portions 13. In this embodiment, in the direction (the left-right direction in FIG. 1) parallel to the longitudinal direction of the head portion 12, there are provided two rows of cleaning portions, with a plurality of cleaning portions 13 arranged in each row. This, however, is merely an example; the number of rows of cleaning portions and the number of cleaning portions 13 arranged in each row may be modified as necessary.

Figure 2:
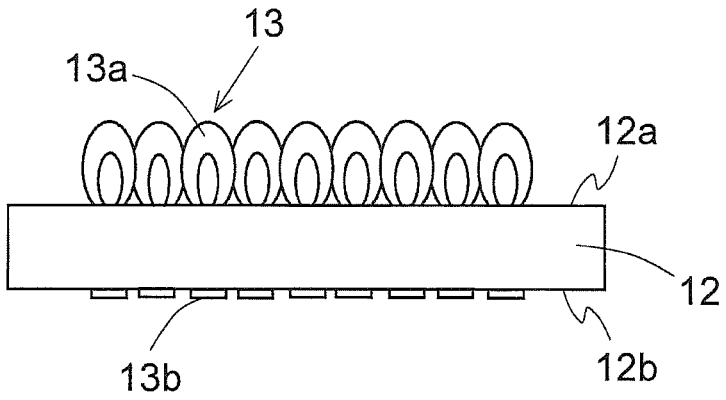
FIG. 2 is a schematic plan view showing the tongue brush as seen from the direction indicated by arrow A in FIG. 1.

FIG. 2 is a schematic plan view of the tongue brush 1 as seen from the direction indicated by arrow A in FIG. 1. As shown in FIG. 2, each cleaning portion 13 has a protrusion 13*a* which protrudes in a loop from a first face 12*a* of the head portion 12 and a secured portion 13*b* which is secured to a second face 12*b* (the face reverse to the first face 12*a*) of the head portion 12. The plurality of cleaning portions 13 are disposed such that their respective protrusions 13*a*, forming loops, point generally in the same direction.

Each cleaning portion 13 is composed of a plurality of brush bristles (a tuft of bristles). The brush bristles can be formed of, but not limited to, synthetic resin such as nylon, polyester, polyimide, polyolefin, or polybutylene terephthalate; natural bristles such as hog bristles; or the like. Each cleaning portion 13 may be composed of a single brush bristle, but preferably it is composed of a plurality of brush bristles as in this embodiment.

Figure 3A:
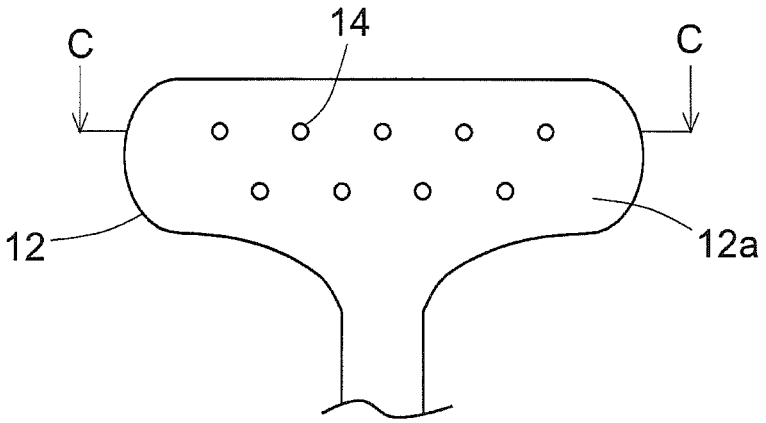
FIG. 3A is a schematic diagram illustrating the structure of a head portion of the tongue brush according to the first embodiment of the present invention, and is a schematic plan view showing the head portion on an enlarged scale.
Figure 3B:
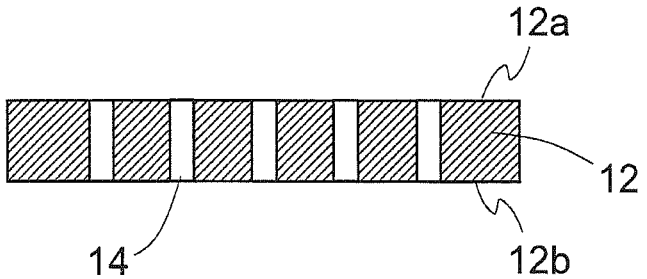
FIG. 3B is a schematic diagram illustrating the structure of the head portion of the tongue brush according to the first embodiment of the present invention, and is a sectional view along line C-C in FIG. 3A.

As shown in FIGS. 3A and 3B, the head portion 12 has formed in it a plurality of through-holes 14 which penetrate the head portion 12 from the first face 12*a* to the second face 12*b*. The through-holes 14 extend in the direction perpendicular to the first and second faces 12*a* and 12*b*. Each cleaning portion 13 is formed by implanting a tuft of bristles in a through-hole 14. The details of how each cleaning portion 13 is produced will be clarified later.

FIGS. 3A and 3B are schematic diagrams illustrating the structure of the head portion 12 provided in the tongue brush 1 according to the first embodiment of the present invention, FIG. 3A being a schematic plan view showing the head portion 12 on an enlarged scale, FIG. 3B being a sectional view along line C-C in FIG. 3A. Although, in this embodiment, the cleaning portions 13 are formed such that their respective protrusions 13*a* have a generally equal height (length from the first face 12*a* of the head portion 12 to the crests of the protrusions 13*a*), this is merely an example; instead, for example, the protrusions 13*a* may have varying heights among different rows of cleaning portions.

The tongue brush 1 of this embodiment is used typically to brush the tongue by using the protrusions 13*a*, forming loops, of the cleaning portions 13 in contact with the tongue. Since the part that makes contact with the tongue is composed of looped bristles, it is possible to rake off tongue coat with a reduced risk of damage to lingual papillae or the like. Moreover, owing to the cleaning portions 13 being composed of brush bristles, they dry quickly, and are easy to keep clean.

Next, one example of a method of manufacturing the tongue brush 1 of the first embodiment will be described with reference to FIGS. 4A, 4B, 4C, and 4D. FIGS. 4A, 4B, 4C, and 4D are schematic diagrams illustrating a method of manufacturing the tongue brush 1 according to the first embodiment of the present invention. The manufacturing process proceeds in the order of FIGS. 4A, 4B, 4C, and 4D.

The manufacture of the tongue brush 1 starts with the production of the base 10 including the head portion 12 where the plurality of through-holes 14 are formed. The base 10 can be formed, for example, through injection molding of plastic pellets.

Figure 4A:
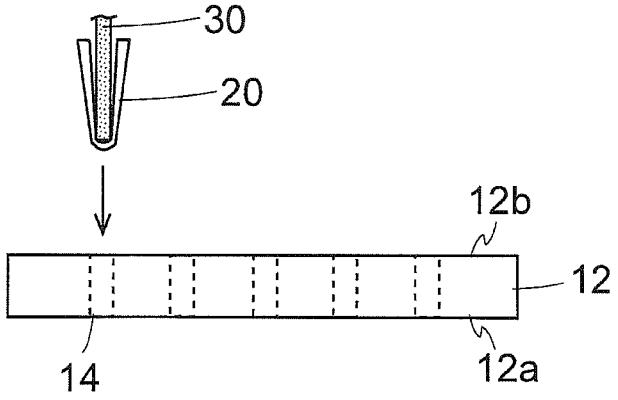
FIG. 4A is a schematic diagram illustrating a method of manufacturing a tongue brush according to the first embodiment of the present invention.

Next, the base 10 is placed in a predetermined position on an unillustrated work table, with the first face 12*a* of the head portion 12 facing down and the second face 12*b* facing up. Then, as shown in FIG. 4A, the position of the work table is adjusted so that, with an implanting needle 30, a tuft of bristles 20 curved generally in a U-shape (folded in two) can be inserted in a predetermined through-hole 14. Although, here, the position of the work table is adjusted, instead, the position of the implanting needle 30 may be adjusted.

Figure 4B:
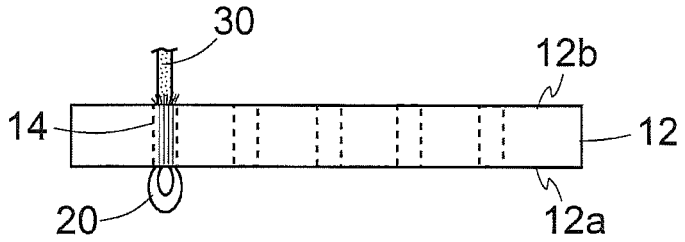
FIG. 4B is a schematic diagram illustrating the method of manufacturing a tongue brush according to the first embodiment of the present invention.

On completion of the adjustment of the position of the work table, then, as shown in FIG. 4B, with the implanting needle 30, the curved tuft of bristles 20 is inserted into the through-hole 14 from one end (upper end) of the through-hole 14. The implanting needle 30 is thrust in until the tuft of bristles 20 protrudes in a loop from the other end (lower end) of the through-hole 14. The tuft of bristles in a loop that has protruded from the first face 12*a* forms the protrusion 13*a* mentioned above, The protrusion 13*a* is composed of a plurality of looped bristles.

In the work table on which the base 10 is placed, there is formed a depression (or a through-hole) to allow the tuft of bristles 20 in a loop to protrude from the other end of the through-hole 14. FIG. 4B shows a state where the implanting needle 30, after being inserted in the through-hole 14 until the tuft of bristles 20 in a loop protrudes from the other end (lower end) of the through-hole 14, is on its way back to the standby position.

Figure 4C:
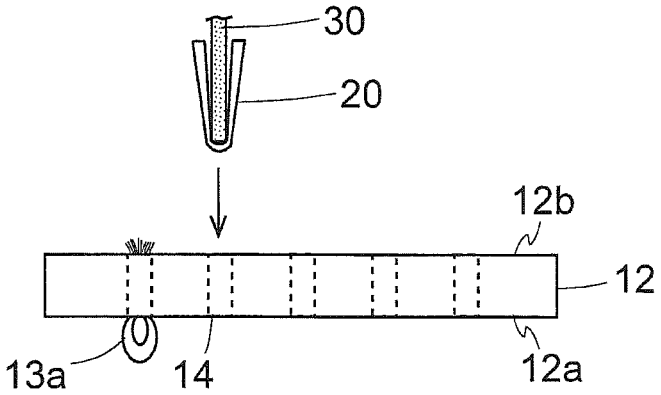
FIG. 4C is a schematic diagram illustrating the method of manufacturing a tongue brush according to the first embodiment of the present invention.

With the implanting needle 30 back at the standby position, as shown in FIG. 4C, the position of the work table on which the base 10 is placed is adjusted so that a curved tuft of bristles 20 can be inserted into the next through-hole 14. Before, after, or at the same time as this takes place, the tuft of bristles 20 to be inserted into the next through-hole 14 is brought to a predetermined position ready to be dispensed. Thereafter, through a procedure similar to that described above, the insertion of the tuft of bristles 20 is performed. Here, inserting the implanting needle 30 into the through-holes 14 to varying depths gives the protrusions 13*a* varying heights; in this embodiment, however, the implanting needle 30 is inserted into the through-holes 14 to an equal depth so that the plurality of protrusions 13*a* have an equal height.

Figure 4D:
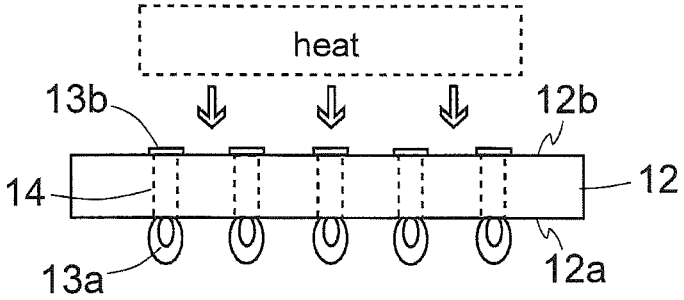
FIG. 4D is a schematic diagram illustrating the method of manufacturing a tongue brush according to the first embodiment of the present invention.

On completion of the insertion, through the procedure described above, of tufts of bristles 20 in all the through-holes 14 provided in the head portion 12, then, as shown in FIG. 4D, thermal fusion is performed at the second face 12*b* such that the tufts of bristles 20 are fastened to the head portion 12. In a case where, for example, the tufts of bristles 20 protrude by an excessive amount from the second face 12*b*, they may be partly cut off before thermal fusion.

Although, in this embodiment, thermal fusion is adopted, this is not meant as any limitation; instead, it is possible to adopt any other method such as high-frequency fusion, ultrasonic fusion, or laser fusion. The point is to fasten tufts of bristles 20 at the second face 12*b* of the head portion 12, and depending on cases, that may be achieved by fastening tufts of bristles 20 with a metal or other fastening member.

Through the process described above, a tongue brush 1 is obtained that has, formed on a first face 12*a* of a head portion 12, a plurality of cleaning portions 13 having protrusions 13*a* (tufts of looped bristles). With this manufacturing method, it is possible to manufacture the tongue brush 1 with a small investment in equipment by use of existing equipment that produces a tooth brush by driving in, along with staples, tufts of bristles in implanting holes (grooves). Moreover, with this manufacturing method, it is easy to handle tufts of bristles when forming looped bristles on a base 10, and thus it is easy to manufacture brushes provided with looped bristles.

Second Embodiment

Next, a brush according to a second embodiment of the present invention will be described. In the description of the brush of the second embodiment, such features as are found also in the tongue brush 1 of the first embodiment will not be discussed again unless necessary.

Figure 5:
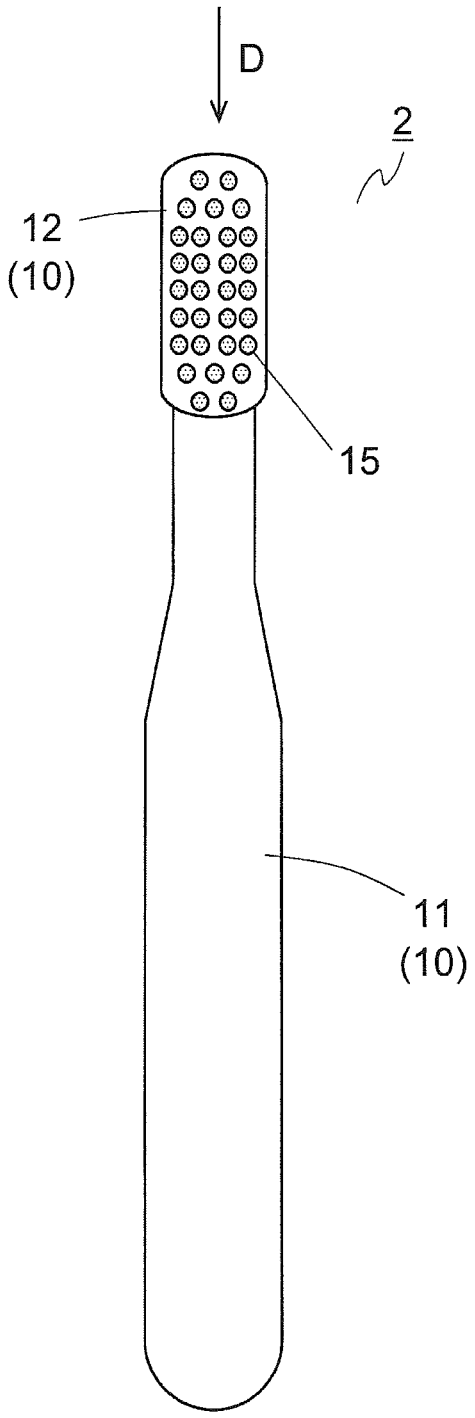
FIG. 5 is a schematic plan view showing the structure of a brush according to a second embodiment of the present invention.

FIG. 5 is a schematic plan view showing the structure of the brush 2 according to the second embodiment of the present invention. The brush 2 of the second embodiment is a multi-function brush that functions both as a toothbrush and a tongue brush. As shown in FIG. 5, like the tongue brush 1 described previously, the multi-function brush 2 comprises a base 10 which has a handle portion 11 and a head portion 12. However, here, the head portion 12 has a slightly different shape than in the tongue brush 1 described previously. The head portion 12 is generally stadium-shaped, meaning that its longitudinal direction runs in the direction (the up-down direction in FIG. 5) parallel to the longitudinal direction of the handle portion 11.

Figure 6:
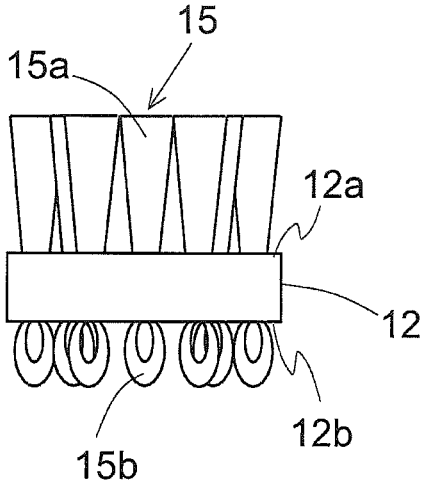
FIG. 6 is a schematic plan view showing the multi-function brush as seen from the direction indicated by arrow D in FIG. 5.

FIG. 6 is a schematic plan view of the multi-function brush 2 as seen from the direction indicated by arrow D in FIG. 5. As shown in FIGS. 5 and 6, in the head portion 12, there are disposed a plurality of cleaning portions 15. The number of cleaning portions 15 and the positions where they are disposed in FIGS. 5 and 6 are merely an example, and may be modified as necessary.

As shown in FIG. 6, each cleaning portion 15 has a first protrusion 15*a* which protrudes, while somewhat widening, from a first face 12*a* of the head portion 12 and a second protrusion 15*b* which protrudes, in a loop, from a second face 12*b* of the head portion 12. The plurality of cleaning portions 15 are disposed such that their respective second protrusions, forming loops, 15*b* point generally in the same direction.

Each cleaning portion 15 is composed of a plurality of brush bristles (a tuft of bristles). In each cleaning portion 15, the first protrusion 15*a* is composed of a plurality of brush bristles that protrude generally straight. On the other hand, in each cleaning portion 15, the second protrusion 15*b* are composed of a plurality of brush bristles that protrude in loops. These brush bristles are, as in the tongue brush 1 of the first embodiment, formed of, but not limited to, synthetic resin such as nylon; natural bristles such as hog bristles; or the like. Each cleaning portion 15 may be composed of a single brush bristle, but preferably it is composed of a plurality of brush bristles as in this embodiment.

Figure 7A:
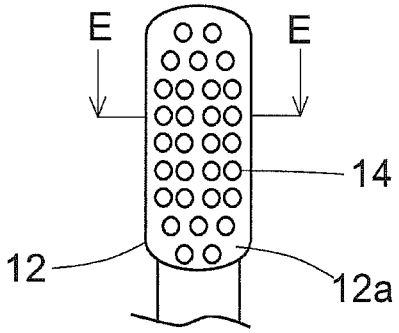
FIG. 7A is a schematic diagram illustrating the structure of a head portion of the multi-function brush according to the second embodiment of the present invention, and is a schematic plan view showing the head portion on an enlarged scale.
Figure 7B:
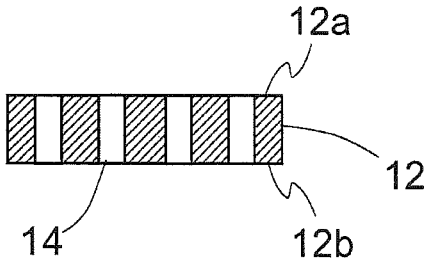
FIG. 7B is a schematic diagram illustrating the structure of the head portion of the multi-function brush according to the second embodiment of the present invention, and is a sectional view along line E-E in FIG. 7A.

FIGS. 7A and 7B are schematic diagrams illustrating the structure of the head portion 12 provided in the multi-function brush 2 according to the second embodiment of the present invention, FIG. 7A being a schematic plan view showing the head portion 12 on an enlarged scale, FIG. 7B being a sectional view along line E-E in FIG. 7A. As shown in FIGS. 7A and 7B, the head portion 12 has formed in it a plurality of through-holes 14 which penetrate the head portion 12 from the first face 12*a* to the second face 12*b*. Each cleaning portion 15 is formed by implanting a tuft of bristles in a through-hole 14. The details of how each cleaning portion 15 is produced will be clarified later.

Although, in this embodiment, the plurality of cleaning portions 15 are formed such that their respective first protrusions 15*a* have generally an equal height and their respective second protrusions 15*b* have generally an equal height, this is merely an example; the plurality of cleaning portions 15 may instead be formed such that the first protrusions 15*a* have varying heights or the second protrusions 15*b* have varying heights.

The multi-function brush 2 of this embodiment can be used typically to brush the teeth by using the first protrusions 15*a* of the cleaning portions 15, and to brush the tongue by using the second protrusions 15*b*. With the multi-function brush 2 of this embodiment, the teeth and the tongue can be cleaned by use of differently shaped tufts of bristles, and this permits effective cleaning of the oral cavity with a reduced risk of damaging it.

Next, one example of a method of manufacturing the multi-function brush 2 of the second embodiment will be described with reference to FIGS. 8A, 8B, 8C, and 8D. FIGS. 8A, 8B, 8C, and 8D are schematic diagrams illustrating a method of manufacturing the multi-function brush 2 according to the second embodiment of the present invention. The manufacturing process proceeds in the order of FIGS. 8A, 8B, 8C, and 8D.

Figure 8A:
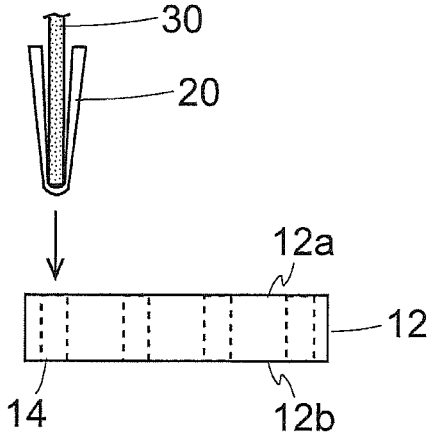
FIG. 8A is a schematic diagram illustrating a method of manufacturing a multi-function brush according to the second embodiment of the present invention.

The manufacture of the multi-function brush 2 starts with the production of the base 10 by a method similar to that for the tongue brush 1 of the first embodiment. Then the base 10 is placed in a predetermined position on an unillustrated work table with the first face 12*a* of the head portion 12 facing up and the second face 12*b* facing down. Then, as shown in FIG. 8A, the position of the work table is adjusted so that, with an implanting needle 30, a tuft of bristles 20 curved generally in a U-shape (folded in two) can be inserted into a predetermined through-hole 14.

Although, here, the position of the work table is adjusted, instead, the position of the implanting needle 30 may be adjusted. Preferably, the tufts of bristles 20 used in the manufacture of the multi-function brush 2 are longer than the tufts of bristles 20 used in the manufacture of the tongue brush 1.

On completion of the adjustment of the position of the work table, as in the manufacturing method of the tongue brush 1 of the first embodiment, with the implanting needle 30, the curved tuft of bristles 20 is inserted into the through-hole 14 from one end (upper end) of the through-hole 14. The implanting needle 30 is thrust in until the tuft of bristles 20 protrudes in a loop from the other end (lower end) of the through-hole 14, and is thereafter pulled out of the through-hole 14 to return to the standby position.

Figure 8B:
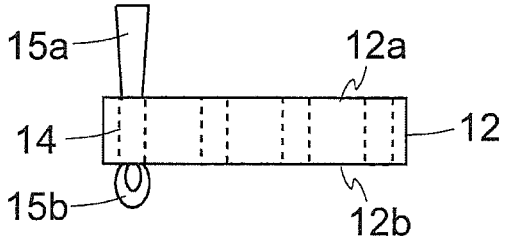
FIG. 8B is a schematic diagram illustrating the method of manufacturing a multi-function brush according to the second embodiment of the present invention.

In this way, as shown in FIG. 8B, a first protrusion 15*a* composed of tufts of bristles protruding generally straight are formed at the first face 12*a*, and a second protrusion 15*b* composed of tufts of bristles protruding in loops are formed at the second face 12*b*. That is, one of the cleaning portions 15 mentioned above is formed.

Figure 8C:
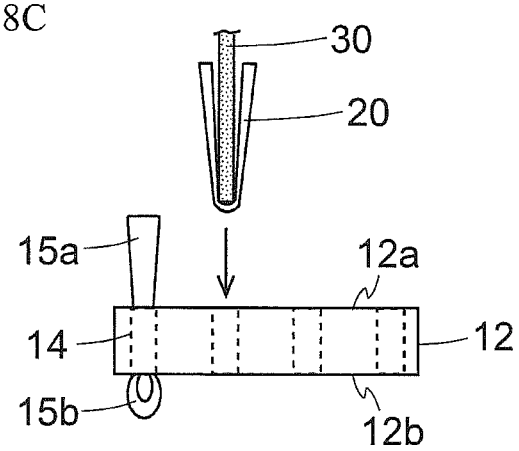
FIG. 8C is a schematic diagram illustrating the method of manufacturing a multi-function brush according to the second embodiment of the present invention.

With the implanting needle 30 back at the standby position, as shown in FIG. 8C, the position of the work table on which the base 10 is placed is adjusted so that a curved tuft of bristles 20 can be inserted into the next through-hole 14. Before, after, or at the same time as this takes place, the tuft of bristles 20 to be inserted into the next through-hole 14 is brought to a predetermined position ready to be dispensed. Thereafter, through a procedure similar to that described above, the insertion of the tuft of bristles 20 is performed.

Figure 8D:
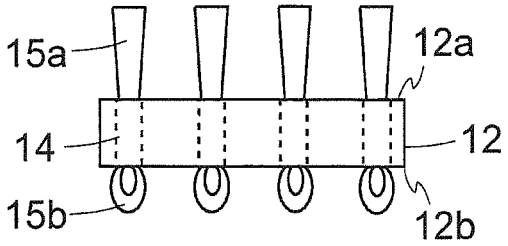
FIG. 8D is a schematic diagram illustrating the method of manufacturing a multi-function brush according to the second embodiment of the present invention.

As shown in FIG. 8D, on completion of the insertion, through the procedure described above, of tufts of bristles 20 in all the through-holes 14 provided in the head portion 12, then the cleaning portions 15 are fastened to the base 10 (head portion 12). The fastening can be achieved by, for example, a method involving the application of pressure from the side of the base 10, a method involving fusion such as thermal fusion, or the like. As yet another method, the cleaning portions can be fastened to the base 10 by use of a fastening member such as a piece of metal.

Through the process described above, a multi-function brush 2 is obtained that has, formed on a head portion 12, a plurality of first protrusions 15*a* (tufts of bristles protruding generally straight) and a plurality of second protrusions 15*b* (tufts of bristles in loops). With this manufacturing method, it is possible to manufacture the multi-function brush 2 with a small investment in equipment by use of existing equipment that produces a tooth brush by driving in, along with staples, tufts of bristles in implanting holes (grooves). Moreover, with this manufacturing method, it is easy to handle tufts of bristles when forming looped bristles on a base 10, and thus it is easy to manufacture brushes provided with looped bristles.

Modified and Other Examples

The embodiments described above are merely a few examples of the present invention. The structures of the embodiments describe above may be modified as necessary within the scope of the technical concepts of the present invention.

For example, in the tongue brush 1 of the first embodiment described above, the parts where the cleaning portions 13 are fastened are visible. This structure, however, is merely one example of the present invention; those parts may instead be covered with a cover 16 as shown in FIG. 9.

Figure 9:
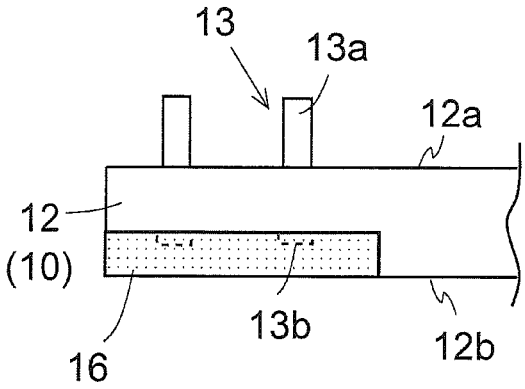
FIG. 9 is a schematic diagram showing a modified example of the tongue brush according to the first embodiment of the present invention.

FIG. 9 is a schematic diagram showing a modified example of the tongue brush 1 according to the first embodiment of the present invention. FIG. 9 is a side view of a part of the head portion 12 of the tongue brush of the modified example as seen from the direction indicated by arrow B in FIG. 1. In this modified example, the head portion 12 of the base 10 has a stepped structure such that the head portion 12 is thicker in its part where the protrusion 13*a* are provided than elsewhere. After the plurality of cleaning portion 13 (tufts of bristles) are fused on, the cover 16 is fitted so as to cover the fused portions 13*b*, so that, as shown in FIG. 9, the bottom face of the base 10 is generally flush. The cover 16 may simply be elastically fitted on the base 10, or depending on cases, may be fastened with a fastening member such as a screw, with adhesive, or otherwise.

In the manufacture of the multi-function brush 2 of the second embodiment, there may be additionally provided a step of partly cutting off tufts of bristles to trim their length such that the first protrusions 15*a* protrude by an equal amount from the first face 12*a* among the plurality of cleaning portions 15. There may be additionally provided, for example, a step of rounding the tips of the bristles of the first protrusions 15*a*.

Although, in the first and second embodiments described above, curved tufts of bristles 20 are inserted one after another in through-holes 14, this merely is an example; instead, depending on cases, the step of inserting curved tufts of bristles 20 into through-holes 14 may be performed concurrently for a plurality of through-holes 14.

Figure 10A:
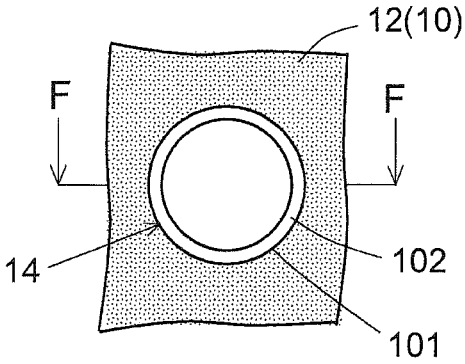
FIG. 10A is a schematic plan view illustrating a modified example of the base provided in the brushes according to the first and second embodiments of the present invention.
Figure 10B:
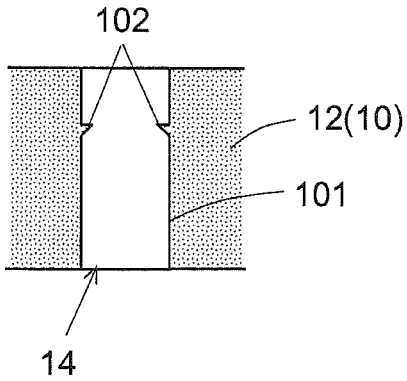
FIG. 10B is a sectional view along line F-F in FIG. 10A.

FIG. 10A is a schematic plan view illustrating a modified example of the base 10 provided in the brushes 1 and 2 of the first and second embodiments of the present invention. FIG. 10B is a sectional view along line F-F in FIG. 10A. In the modified example shown in FIGS. 10A and 10B, the base 10 has a projection 102 that projects from the inner wall face 101 forming a through-hole 14. More specifically, the projection 102 is provided on the head portion 12. In this modified example, the projection 102 belongs to the same member as the head portion 12, and is formed unitarily with the head portion 12. However, the projection 102 may instead be a member separate from the head portion 12.

In this modified example, the projection 102 is annular as seen in a plan view. That is, the projection 102 is continuous in the circumferential direction of the inner wall face 101. This, however, is merely an example; the projection 102 may instead be discontinuous in the circumferential direction. The projection 102 may be provided at any position in the direction in which the through-hole 14 extends, but preferably it is provided at a position away from the end of the through-hole 14. The direction in which the through-hole 14 extends is the direction perpendicular to the plane of FIG. 10A, and is the up-down direction in FIG. 10B. Preferably, the projection 102 is provided such that a tip end part of it is elastically deformable. In this modified example, the projection 102 is formed of resin. The projection 102 is so structured as to be increasingly thin toward its tip end, so that its tip end part is elastically deformable.

In the manufacture of the brushes 1 and 2, an implanting needle 30 is, along with a tuft of bristles 20, inserted into the through-hole 14. When the implanting needle 30 is pulled out of the through-hole 14, at least part of the tuft of bristles 20 tends to move together with the implanting needle 30, but the projection 102 makes contact with at least another part of the tuft of bristles 20 and thereby hampers that move. Thus, in this modified example, even without any special height adjustment after the insertion of tufts of bristles 20 in the through-holes 14, the tufts of bristles 20 can be arranged with generally an equal height for a plurality of through-holes 14.

Figure 11:
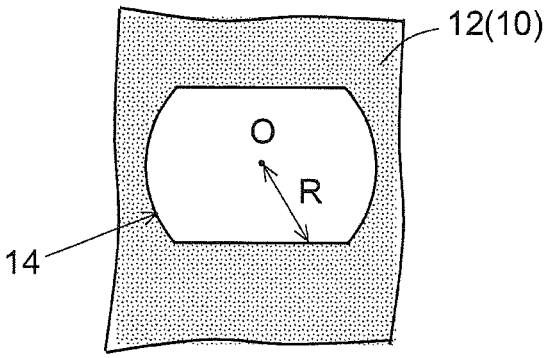
FIG. 11 is a schematic plan view showing a modified example of the through-hole formed in the head portion provided in the brushes according to the first and second embodiments of the present invention.

FIG. 11 is a schematic plan view showing a modified example of the through-hole 14 formed in the head portion 12 of the base 10 provided in the brushes 1 and 2 according to the first and second embodiments of the present invention. In the first and second embodiments, the through-hole 14 is circular as seen in a plan view; by contrast, in this modified example, the through-hole 14 is non-circular as seen in a plan view. More specifically, in this modified example, the through-hole 14 is generally stadium-shaped.

This, however, is merely an example; the through-hole 14 may have any other non-circular shape. The through-hole 14 may have a shape with a varying distance R from the center C of the through-hole 14 to the circumference as seen in a plan view. For example, the through-hole 14 may have a non-circular, rotationally symmetric shape. The through-hole 14 may be rectangular or otherwise polygonal, elliptical, or of any other shape. Giving the through-hole 14 a non-circular shape as in this modified example helps prevent rotation of the tuft of bristles 20 inserted in the through-hole 14 with the implanting needle 30. That is, with this modified example, it is easy to manufacture brushes 1 and 2 in which the plurality of cleaning portions 13 and 15 formed on the head portion 12 point in the same direction.

Depending on cases, the brush manufacturing method according to the present invention may be applied not to a tongue brush 1 or a multi-function brush 2 as discussed above but to common toothbrushes that have brush bristles protruding generally straight from one face of a base 10. In that case, while the toothbrush is manufactured by a method generally similar to that for the multi-function brush 2 described above, the brush bristles are fastened to the base 10 by a different technique. In this toothbrush manufacturing method, brush bristles are fused to the base 10 at the other end of the through-holes 14 where the looped tufts of bristles 20 protrude. That is, the brush bristles are fastened to the base 10 by fusion of the looped parts of tufts of bristles 20.

While the present invention is suitable for oral cavity cleaning utensils such as tongue brushes, this is not meant to limit its application to oral cavity cleaning utensils; the present invention finds wide application in brushes for other uses (for example, brushes for painting, and the like).

LIST OF REFERENCE SIGNS

1 tongue brush
2 multi-function brush
10 base
12*a* first face
12*b* second face
13*a* protrusion (a plurality of looped bristles)
14 through-hole
15*a* first protrusion (a plurality of generally straight bristles)
15*b* second protrusion (a plurality of looped bristles)
16 cover
20 tuft of bristles (tuft of brush bristles)
101 inner wall face
102 projection

The invention claimed is:

1. A method of manufacturing a brush, comprising:
a first step of forming a base with a through-hole; and
a second step of inserting, with an implanting needle, a curved brush bristle into the through-hole from one end of the through-hole and making a looped bristle protrude from another end of the through-hole,
wherein
already before the second step is performed, the base has, at a position away from both ends of the through-hole, a uniform projection that projects from an inner wall face forming the through-hole, and extends along the entirety of the circumference of the through-hole.

2. The method according to claim 1, further comprising:
a third step of fastening the brush bristle including the looped bristle to the base.

3. The method according to claim 2, wherein
the brush bristle is fastened to the base by fusion.

4. The method according to claim 3, wherein
the brush bristle is fastened to the base at the one end of the through-hole.

5. The method according to claim 3, wherein
the brush bristle is fastened to the base at the another end of the through-hole.

6. The method according to claim 2, further comprising:
a step of covering a part where the brush bristle is fastened to the base with a cover.

7. The method according to claim 2, wherein
the through-hole is provided in a part of the base thinner than elsewhere due to the base having a stepped structure,
the looped bristle protrudes from a face of the base reverse to a face thereof where a step is formed, and
the brush bristle is fastened to the base such that, at the face of the base where the step is formed, a height of the brush bristle is smaller than a height of the step.

8. The method according to claim 1, wherein
the through-hole is non-circular as seen in a plan view.

9. The method according to claim 1, wherein the at least one projection continuously extends along the inner wall face.

10. The method according to claim 1, wherein the at least one projection is annular.

11. A brush, comprising:
a base; and
a brush bristle protruding in a loop from a surface of the base; and
a uniform projection that projects from an inner wall forming a through-hole in the base into which the brush bristle is inserted, and extends along the entirety of the circumference of the through-hole,
wherein
the projection is elastically deformable at a position away from both ends of the through-hole in a direction in which the through-hole extends.

12. The brush according to claim 11, wherein
the brush bristle is fastened to the base on a face reverse to the surface of the base,
a cover is fitted on the face reverse to the surface of the base, the cover covering a part where the brush bristle is fastened.

13. The brush according to claim 11, wherein
the brush bristle protrudes generally straight from the face reverse to the face of the base.

14. The brush according to claim 11, wherein
the brush has a first face which is the surface and a second face which is reverse to the first face;
the brush bristle is fastened to the base at the second face of the base, and
the brush is a tongue brush.

15. The brush according to claim 11, wherein the hole is non-circular as seen in a plan view.

16. The brush according to claim 11, wherein the at least one projection continuously extends along the inner wall face.

17. The method according to claim 11, wherein the at least one projection is annular.

* * * * *